United States Patent [19]

Delessard et al.

[11] 4,174,947

[45] Nov. 20, 1979

[54] INSTALLATION AND PROCESS FOR REGULATING THE PREHEATING OF COKING COAL

[75] Inventors: Serge L. Delessard, Forbach; Roger M. Puff, Hombourg-Haut, both of France

[73] Assignee: Charbonnages de France, Paris, France

[21] Appl. No.: 870,594

[22] Filed: Jan. 18, 1978

[30] Foreign Application Priority Data

Jan. 24, 1977 [FR] France ..... 77 01871

[51] Int. Cl.[2] ..... F27B 15/00

[52] U.S. Cl. ..... 432/15; 241/17; 432/58

[58] Field of Search ..... 432/14, 15, 58; 241/17

[56] References Cited

U.S. PATENT DOCUMENTS

| | | | |
|---|---|---|---|
| 2,235,683 | 3/1941 | Horesi | 241/17 |
| 3,250,016 | 5/1966 | Agarwal | 432/58 |
| 4,060,393 | 11/1977 | Ito | 432/58 |
| 4,070,765 | 1/1978 | Hovmaud et al. | 432/14 |

FOREIGN PATENT DOCUMENTS

| | | | |
|---|---|---|---|
| 2281971 | 12/1976 | France | 432/26 |

*Primary Examiner*—John J. Camby

*Attorney, Agent, or Firm*—Cushman, Darby & Cushman

[57] ABSTRACT

Coking coal is preheated in a fluidization chamber which houses a rotary percussion grinder and into the bottom of which a vertical pipe leads from a combustion chamber. Coal is introduced into the pipe and is entrained by gas in the pipe which gas subsequently acts as fluidization agent in the fluidization chamber. A main burner and an auxiliary burner in the combustion chamber are regulated by regulating the supply of combustion air so that the gas in the pipe is substantially neutral, and regulating the fuel supply in dependence on the temperature in the fluidization chamber. Preheated ground coal entrained in gas is led from the top of the fluidization chamber, and gas is recycled to the combustion chamber in an amount so that the speed of total gas flow in the fluidized coal is constant.

10 Claims, 4 Drawing Figures

INSTALLATION AND PROCESS FOR REGULATING THE PREHEATING OF COKING COAL

BACKGROUND OF THE INVENTION

1. Field of the Invention

The invention relates to an installation and a process for maintaining at desired temperature values, in any circumstances, a coal preheating installation comprising at least one drying chamber fed by a fluidisation agent, a combustion chamber having a neutral combustion burner producing a hot neutral gas serving as entrainment agent and as drying and fluidisation agent, and means for regulating the supply of liquid or gaseous fuel to the burner which are controlled by means for measuring the temperature in the drying chamber.

2. Description of the Prior Art

In the technique of charging coke fines by preheating the fines, it is known to prepare a charge of coal by grinding and drying in a fluidisation reactor known as a grinder-drier, in which a grinding member rotates and from which the suitably ground coal, heated to between 100° C. and 260° C., is entrained into a waiting hopper. In an installation of this kind it may be necessary to interrupt the supply of coal to the grinder-drier, for example because of an incident upstream or downstream of that apparatus. However, if the burner is not then extinguished there is a risk that the temperature of the installation will rise to an excessive value, resulting in the coking of the wet coal stagnating in the supply part, so that there will be a danger that the installation cannot be started up again under normal conditions.

For solving this problem it has already been proposed in French Patent Application No. 75,25425 (Publication No. 2,281,971) to reduce the power of the burner to its minimum value and to inject, preferably upstream of the grinder-drier, water whose heat of vaporisation will absorb the heat produced by the burner working at its minimum power, thereby eliminating the risk of coking.

However, a solution of this kind is not without disadvantages.

One disadvantage of the above solution is that the refractory materials are damaged by too abrupt cooling by water in one of the hottest zones of the installation. Furthermore, the amount of water used must be relatively large, because owing to the fact that the gases coming from the combustion chamber must be neutral the flexibility of regulation of the burner is limited to a range between its nominal power and about one-third of that power. Fuel is therefore consumed entirely wastefully, because in the interim period one-third of the nominal power of the burner is used for vaporising water.

SUMMARY OF THE INVENTION

The invention relates to a coal preheating installation of the kind comprising a drier-grinder-preheater consisting of a vertical rising pipe for entrainment of coal by a gaseous entraining agent, means for introducing coal into the vertical entrainment pipe, a fluidisation chamber at the bottom of which the vertical rising coal entrainment pipe has its outlet, and in which the gaseous entrainment agent in the rising pipe acts as fluidisation agent, a rotary percussion grinder housed in the fluidisation chamber near the bottom of the latter, and a pipe for entrainment of the preheated, ground coal starting vertically at the top of the fluidisation chamber. A combustion chamber for the production of the gaseous entrainment and fluidisation agent has its outlet connected to the base of the vertical rising coal entrainment pipe. This combustion chamber contains a neutral main burner of suitable nominal thermal power capable of operating within a range of powers lower than this nominal power, means for regulating the combustion air supplied to the burner so that the gaseous entrainment and fluidisation agent will be substantially neutral, means for regulating the liquid or gaseous fuel supplied to the burner, these means being controlled by means for measuring the temperature in the fluidisation chamber, and means for recycling part of the gaseous entrainment and fluidisation agent into the combustion chamber in an amount so regulated that the speed of the total gas flow will be kept constant in the fluidisation zone. Additionally the combustion chamber contains an auxiliary neutral burner whose nominal thermal power is lower than the lowest power of the power range of the main burner and which has means for regulating the combustion air so that the combustion gases will be substantially neutral, and also has means for regulating the flow of liquid or gaseous fuel which are controlled by means for measuring the temperature in the fluidisation chamber.

An auxiliary burner of this kind is technically different from an ignition burner which is not designed to be regulated by means which make it possible to obtain neutral gases, or means for regulating the flow of liquid or gaseous fuel which can be controlled by temperature measuring means.

The auxiliary burner can serve as ignition burner, thus making it unnecessary to install three burners.

It is possible for the auxiliary burner to contain in addition regulation means controlled in dependence on the operation of the main burner. In practice, it will be advantageous to adjust the auxiliary burner to its minimum power as long as the main burner is in use and to switch the thermal regulation means of the main burner to the auxiliary burner when the set temperature in the fluidisation chamber is exceeded to such an extent as to bring about the extinction of the main burner, as is known per se. In this way it is possible, if desired, to have only a single regulation device which in normal operation regulates the main burner and extinguishes the main burner if there is overheating, which is the most economical means, but nevertheless regulates the temperature in the event of the extinction of the main burner and even before its ignition.

It is preferable for the combustion chamber to have means of introducing hot gaseous ballast, such as water vapour. Water vapour is advantageous, and not water requiring heat for its vaporisation. This water vapour makes it possible to keep the installation under slight super-atmospheric pressure in order to prevent any admission of air.

It is advantageous for the means for introducing hot gaseous ballast to be controlled by the means for introducing coal into the vertical entrainment pipe.

In this way pressurisation is maintained practically at the very moment when the regulation device intervenes to extinguish the main burner as the result of the cessation of the supply of coal.

In a preferred embodiment the main burner and the auxiliary burner are combined concentrically to form a double burner.

In a process of the kind initially described above the objects of the invention are achieved because the range of regulation of thermal power is extended in the downward direction by providing in the combustion chamber an auxiliary burner whose thermal power is lower than the lowest power of the range of power of the main burner, and by regulating the auxiliary burner in dependence on the temperature measured in the fluidisation chamber at least during the periods of extinction of the main burner.

In this way, instead of having a narrow range of regulation of power resulting from a single burner, adjustability is considerably extended because of the two ranges of adjustment.

During the periods of operation of the main burner it is advantageous to regulate the auxiliary burner at its minimum power, while during periods of extinction of the main burner it is advantageous to inject a gaseous ballast, such as water vapour, into the installation, this gaseous ballast preferably being injected into the combustion chamber.

BRIEF DESCRIPTION OF THE DRAWINGS

An embodiment of the invention will now be described, by way of example, with reference to the accompanying drawings, in which.

DESCRIPTION OF THE PREFERRED EMBODIMENTS

Figure 1:
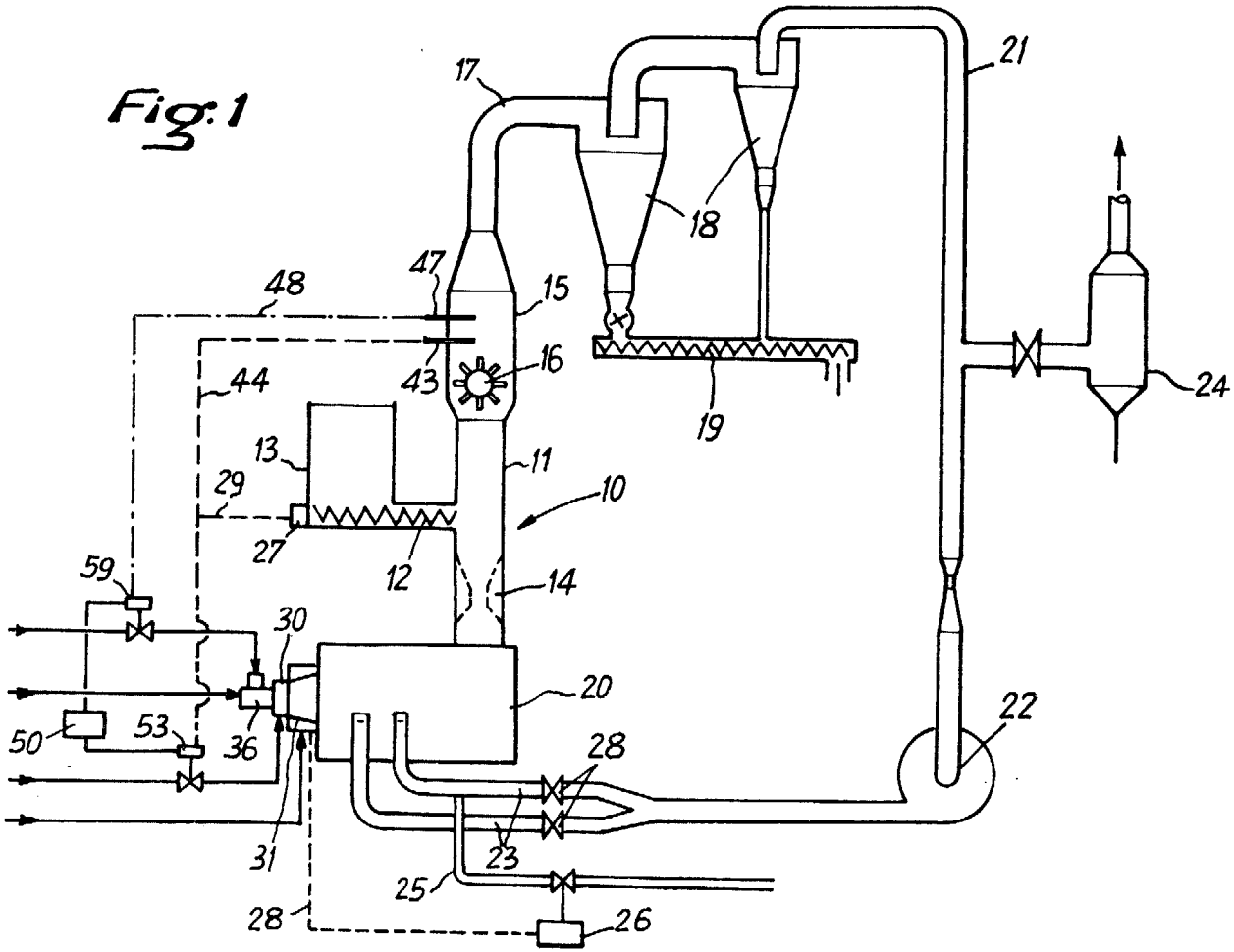
FIG. 1 is a diagram of an installation according to the invention for carrying out the process of the invention.
Figure 2:
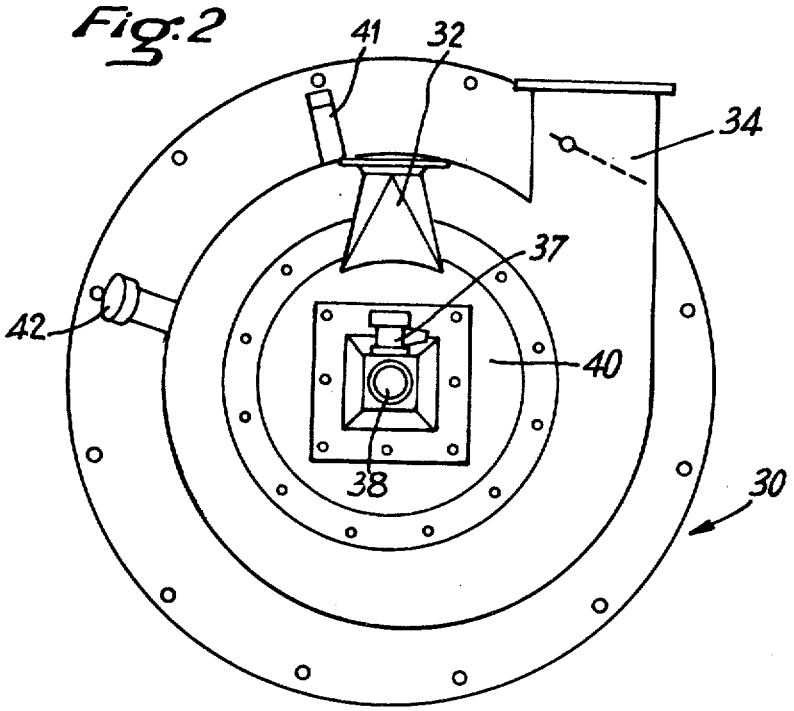
FIGS. 2 and 3 are respectively a front view and an axial section of a double burner used in the installation illustrated in FIG. 1.
Figure 3:
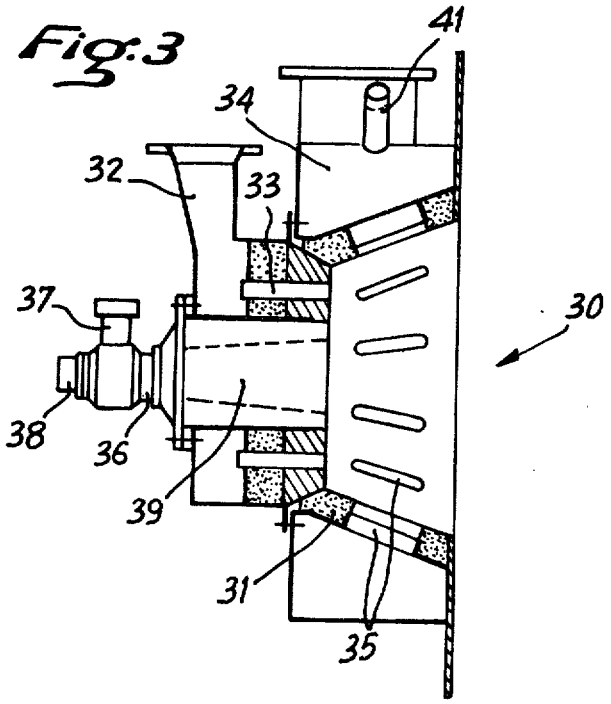

Referring to FIG. 1, a coal preheating installation comprises a drier-grinder-preheater unit given the general reference 10. This unit contains a vertical rising pipe 11 for the entrainment of coal by a gaseous entrainment agent, and a screw conveyor 12 which supplies the coal from a hopper 13 to the pipe 11 at a point situated above a venturi 14 provided in the lower part of the pipe 11. Above the pipe 11 there is a fluidisation chamber 15, into the bottom of which the pipe 11 leads, at a point below a rotary percussion grinder 16. From the top of the chamber 15 there extends a pipe 17 for the entrainment of preheated, ground coal from the chamber 15. The pipe 17 leads this entrained coal towards a battery of cyclones 18, at the outlet from which this coal is recovered and transported by a conveyor 19 to a storage hopper for subsequent charging to a coke furnace. At the vortex of the cyclones 18 the smoke is collected in a pipe 21.

The installation also comprises a combustion chamber 20 leading into the bottom of the rising pipe 11, as well as means for regulating the air supplied to a burner in the combustion chamber 20 in order to ensure that the combustion will be substantially neutral. It is in addition provided with fuel regulation means controlled by means for measuring the temperature in the fluidisation chamber and a fan 22 which by way of ducts 23 recycles part of the gaseous agent taken off at 21 in an amount so controlled that the speed of the total gas flow will be kept constant in the fluidisation chamber. The installation also includes a dust extractor 24 in the pipe 21.

What has been described so far with reference to FIG. 1 is known per se.

The combustion chamber has two burners. In the installation illustrated these two burners are mounted concentrically in the form of a double burner 30 comprising a peripheral main burner 31 provided with a gas inlet 32 having nozzles 33 surrounded by air nozzles 35 served by an air inlet 34, and a central auxiliary burner 36 comprising a gas inlet 37 having an air nozzle 38 leading into a combustion ante-chamber 39. The double burner 30 has the usual accessories, namely an ignition electrode 40 in the combustion ante-chamber 39, a monitoring cell 41, and a viewing port 42.

The main burner has a nominal power of 2700 th/h with a power range of 900 to 2700 th/h. The auxiliary burner has a nominal power of 180 th/h, with a power range from 45 to 180 th/h.

Figure 4:
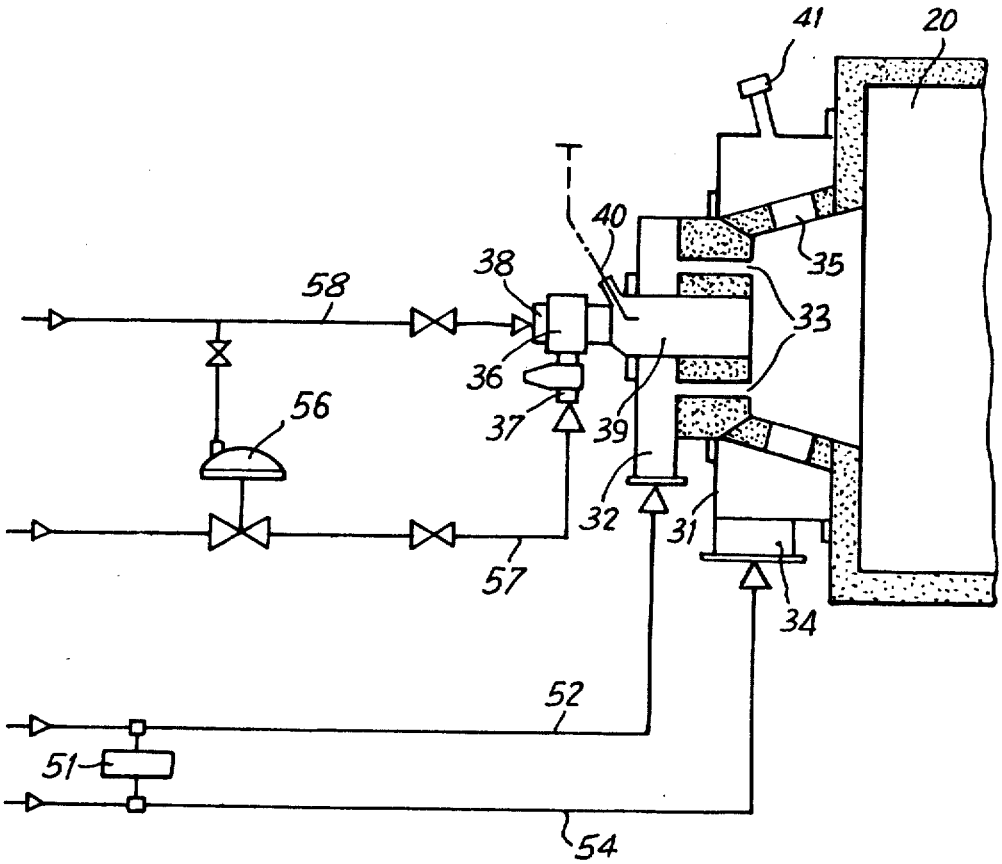
FIG. 4 illustrates diagramatically the supply of fluids to the burners.

The gas arriving at the inlet 32 and the air arriving at the inlet 34 of the main burner 31 are supplied respectively through pipes 52 and 54, FIG. 4, having between them a device 51 for regulation in stoichiometrical proportions, ensuring substantially neutral combustion. A gas flow regulation device 53 shown in FIG. 1 enables the gas flow to be controlled in accordance with information transmitted through a line 44 of a thermocouple 43 disposed in the chamber 15. The regulation device 53 controls the feeding of the main burner in accordance with the information supplied by a pick-up 27 indicating the operation of the feed screw 12.

The gas arriving at the inlet 37 of the auxiliary burner 36 and the air arriving at the inlet 38 of that burner are supplied respectively through pipes 57 and 58, FIG. 4, having between them a device 56 for regulation in stoichiometrical proportions, thus ensuring substantially neutral combustion. A gas flow regulation device 59 shown in FIG. 1 enables the gas flow to be controlled in accordance with the information transmitted by a line 48 of a thermocouple 47 disposed in the chamber 15.

The regulation device 59 for the auxiliary burner is in addition controlled in dependence on the functioning of the first burner through the medium of a logic circuit 50, in such a manner that the device 59 intervenes only in the event of the extinction of the main burner.

The regulation devices 53 and 59 may be only a single device, in which case the logic circuit 50 intervenes to direct to one burner or the other the regulation instructions in dependence on information concerning the temperature, the operation of the feed screw, and the operation of the main burner.

The installation also contains a pipe 25 for the introduction of steam into the combustion chamber 20 through one of the ducts 23. The opening of the pipe 25 is controlled by a servo control device connected by a connection 28 to the flame monitoring cell of the main burner.

In the installation described the auxiliary burner also serves for the ignition of the main burner; it remains in operation at minimum power when the main burner is operating, and finally it serves for the supply of heat required during so-called "waiting condition" operation.

In an installation of this kind it is proposed to obtain a temperature of 250° to 260° C. in the fluidisation chamber with a coal flow of 10 t/h. The calorific supply at the burners should experimentally be 1400 th/h and the no-load speed of the smoke in the treatment zone of the said chamber should be 5 m/s.

It may become necessary to go over to waiting conditions for various reasons entailing stoppage of the supply of coal:

(a) Upstream of the preheater: stoppages in the wet coal feed system.

(b) Downstream of the preheater: stoppages in the furnace charging system.

In the latter case, the procedure will be as follows:

the flow of wet coal introduced into the preheater is first reduced to the minimum, that is to say close to half-power;

in the main burner the flows of air and gas are automatically reduced to a minimum value, the temperature in the treatment zone being maintained at 250° to 260° C.;

when the waiting hopper for preheated coal is full, the feeding of crude coal is stopped;

the no-load speed in the preheater can be kept at 5 m/s or reduced to a value compatible with the operation of the installation;

the main burner is stopped, and the auxiliary burner then alone remains in operation. Its regulation system keeps the temperature at 250° to 260° C.;

steam is injected automatically into the combustion chamber through an inlet 25 provided downstream of regulation valves 28 disposed on the recycled smoke ducts 23.

These last two operations are characteristic of the process of the invention.

In the event of stoppage of the wet coal supply system, the main burner is immediately extinguished and the auxiliary burner alone remains in regulated operation as in the previous case, and steam is likewise injected as previously.

The Applicants were able to obtain the following operating conditions:

temperature in the treatment zone: 250° to 260° C.
flow of coal: nil
calorific supply at auxiliary burner: 60 th/h
no-load speed in treatment zone: 3.5 m/s
flow of steam at 200° to 210° C.: 200 kg/h During this operation under waiting conditions the calorific output of the auxiliary burner is adjusted to maintain the required temperature, this burner being designed for the purpose.

In order to return to normal conditions, all that is required is:

to put the main burner into regulated service while returning the auxiliary burner to minimum power. The air and gas valves of the main burner are preset for the minimum values defined above;

to return eventually to the speed of 5 m/s;

to put the wet coal screw into operation at minimum delivery;

and then to increase the flow of coal, adjusting temperatures to the set values and increasing the flow of air and gas.

I claim:

1. In a coal preheating installation comprising:

a drier-grinder-preheater which includes:

a vertical rising pipe for entrainment of coal by a gaseous entrainment agent;

means for introducing coal into the vertical rising coal entrainment pipe;

a fluidisation chamber with the bottom of which the vertical rising coal entrainment pipe communicates and in which the gaseous entrainment agent in the vertical rising coal entrainment pipe acts as fluidisation agent;

a rotary percussion grinder housed in the fluidisation chamber near the bottom of the chamber;

means for measuring the temperature in the fluidisation chamber;

a pipe for entrainment of preheated, ground coal, extending vertically from the top of the fluidisation chamber;

a combustion chamber for the production of the gaseous entrainment and fluidisation agent, having an outlet to which the bottom of the vertical rising coal entrainment pipe is connected, the said combustion chamber containing a neutral main burner of suitable nominal thermal power capable of operating within a power range lower than said nominal power;

means for regulating combustion air supplied to said main burner so that the gaseous entrainment and fluidisation agent will be substantially neutral;

means for regulating a supply of liquid or gaseous fuel to the main burner, which regulating means is controlled by said temperature measuring means;

and means for recycling part of the gaseous entrainment and fluidisation agent into the combustion chamber in an amount so regulated that the speed of total gas flow will be kept constant in the fluidisation chamber;

the improvement wherein said coal preheating installation further comprises:

an auxiliary neutral burner in the combustion chamber, the nominal thermal power of which auxiliary burner is lower than the lowest power of said power range of the main burner;

means for regulating combustion air supplied to said auxiliary burner so that the combustion gases will be substantially neutral; and means for regulating the flow of liquid or gaseous fuel to said auxiliary burner, which regulating means is controlled by means for measuring the temperature in the fluidisation chamber.

2. A preheating installation according to claim 1, wherein the auxiliary burner comprises regulation means controlled in dependence on the operation of the main burner.

3. A preheating installation according to claim 1, wherein the combustion chamber has means for introducing hot gaseous ballast, such as water vapour.

4. An installation according to claim 3, wherein the means for introducing hot gaseous ballast are controlled by said means for introducing coal into the vertical entrainment pipe.

5. An installation according to claim 1, wherein the main burner and the auxiliary burner are combined concentrically to form a double burner.

6. For maintaining at desired temperature values, in any circumstances, a coal preheating installation having at least one drying chamber fed with a fluidisation agent, a combustion chamber having a main neutral combustion burner producing a hot neutral gas serving as entrainment agent and as drying and fluidisation agent, and means for regulating the feeding of the main burner with liquid or gaseous fuel which are controlled by means for measuring the temperature in the fluidisation chamber, a process comprising:

providing an auxiliary burner having a thermal power range lower than the lowest power of the range of power of said main burner and;

regulating said auxiliary burner in dependence on the temperature measured in the fluidisation chamber at least during periods of extinction of the main burner, thereby extending in the downward direction the range of regulation of thermal power in the combustion chamber.

7. A process according to claim 6, comprising regulating the auxiliary burner at its minimum power during the periods of operation of the main burner.

8. A process according to claim 6, comprising injecting gaseous ballast, such as water vapour, into the installation during said periods of extinction of the main burner.

9. A process according to claim 8, comprising injecting the gaseous ballast into the combustion chamber.

10. A process according to claim 6, comprising using the auxiliary burner as an ignition burner.

* * * * *